United States Patent [19]

Rutten

[11] 4,445,436

[45] May 1, 1984

[54] PROJECTILE FOR CENTRIFUGAL LAUNCHING DEVICE

[76] Inventor: Léon L. Rutten, 29, rue Duvivier, 4000 Liege, Belgium

[21] Appl. No.: 326,009

[22] Filed: Nov. 30, 1981

[30] Foreign Application Priority Data

Dec. 4, 1980 [BE] Belgium ..... PV2/58886

[51] Int. Cl.[3] ..... F42B 11/02

[52] U.S. Cl. ..... 102/501; 124/6

[58] Field of Search ..... 102/501, 507–510, 102/514–516, 517–519; 124/6

[56] References Cited

U.S. PATENT DOCUMENTS

| | | | |
|---|---|---|---|
| 179,054 | 6/1876 | Pollard | 102/501 |
| 2,868,130 | 1/1959 | Gulley et al. | 102/501 |
| 3,782,287 | 1/1974 | Sie | 102/516 |

FOREIGN PATENT DOCUMENTS

| | | | |
|---|---|---|---|
| 130405 | 8/1919 | United Kingdom | 102/501 |

*Primary Examiner*—Harold J. Tudor
*Assistant Examiner*—Tyrone Davis
*Attorney, Agent, or Firm*—Bacon & Thomas

[57] ABSTRACT

A projectile for a gun-vane centrifugal launching device is disclosed, of the type with an ogival head, a body and a tail of decreasing section. The body is cylindrical and the weight of the tail is chosen in such a way that the center of gravity of the projectile lays in the plane where the body joins the tail or in the immediate vicinity of this plane. The shape of the said tail is such that no point of the surface of the latter touches the wall of the gun-vane, particularly during the ejection of the projectile.

2 Claims, 2 Drawing Figures

PROJECTILE FOR CENTRIFUGAL LAUNCHING DEVICE

BACKGROUND OF THE INVENTION

The present invention relates to a projectile for a centrifugal launching device.

Centrifugal launching devices or launchers have been known since more than a century in different fields; shotblasting machines, sports, toys, armaments.

The present invention only relates to the field of armaments.

In this field high initial speeds (800 m/s and more) are required at present.

In order to obtain such high speeds while keeping the dimensions of the launcher relatively compact, it is necessary to subject the projectile to the centrifugal or radial acceleration and to the Coriolis acceleration which is perpendicular to the first one. So, the resulting speed is composed of a radial speed and a tangential speed, both speeds being perpendicular to each other.

It results therefrom that a gun-vane launcher is preferred, an example of which is described in an other patent application of the Applicant, filed on even date herewith (Ser. No. 521,013 for a "Rotor for Centrifugal Launching Device" filed on Aug. 9, 1983, a continuation of Ser. No. 326,003 filed on Nov. 30, 1981, now abandoned).

A strict exactness of the initial trajectory is of course required; this involves considerable difficulties on the level of the feeding, that has to be rigorous as well, both in place and in time.

For this reason the large majority of proposed solutions these days appeal to spherical projectiles or balls.

Well then, the combination of a rotational speed and a radial speed brings about a so-called Coriolis acceleration.

By way of example, calculations show that for a steel ball of 20 mm across (steel with an average admissible stress of 100 kg/mm$^2$), launched by a 475 mm gunvane so as to obtain an initial speed of 800 m/s, the Coriolis force attains 4400 kg.

The Herz contact would in these conditions provoque a deformation of the ball in a meridial plane with an area of 44 mm$^2$.

As this is inadmissible it is clear that the muzzle speed should be limited to far below 500 m/s.

Thus the spherical shape should be rejected for a modern projectile, the more as it is difficult to see how a projectile of this shape could be equipped with an impact rocket explosive charge.

So, the object of the invention is to provide a projectile as resemblant as possible to projectiles of conventional arms, but adapted for being efficiently used in a centrifugal machine equipped with a gun-vane.

This objective is achieved, according to the invention, by a projectile of the ogival head-type, with a body and a tail of decreasing section, characterized in that the body is cylindrical and that the weight of the tail is chosen in such way that the center of gravity of the projectile lays in a plane where the cylindrical body connects to the tail or in the immediate vicinity of this plane, whereas the shape of the said tail is chosen so that no point of the surface of the latter touches the wall of the gun-vane, particularly during the ejection of the projectile.

According to the invention the cylindrical body of the projectile is intended to take up the Coriolis force, which in any point is represented by:

$$F_t = Km\omega^2 r f(\eta)$$

wherein:

K is a constant, m is the mass of the projectile, $\omega$ the angular speed of the projectile, r the radius of the point considered, $f(\eta)$ is a function of the coefficient of friction.

For a projectile of 122 g, ejected at 800 m/s by a gun-vane (20 mm calibre) with a length of 475 mm, with an $\eta=0.2$, the Coriolis force attains 16427 kg.

So one sees the importance of the cylindrical shape of the body according to the invention.

The double condition of the position of the centre of gravity of the projectile and of the shape of the tail avoids any tilting of the projectile during launching.

BRIEF DESCRIPTION OF THE DRAWINGS

For more clearness the description is continued with reference to the accompanying drawings, in which.

Figure 1:
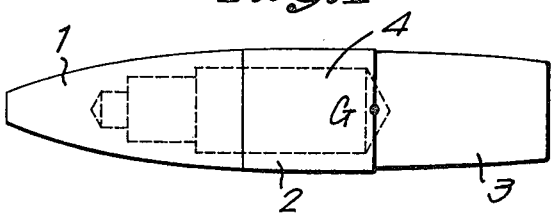
FIG. 1 shows a projectile according to the invention.

So, the projectile represented in FIG. 1 consists in an ogival head 1, a cylindrical body 2 and a tail having a decreasing section 3. These three parts have recesses generally indicated in 4, intended to contribute to exact positioning of the centre of gravity G. In this concrete example the projectile made of steel has a length of 92 mm, a maximum diametre of 20 mm (body 2) and a weight of 122 g.

Figure 2:
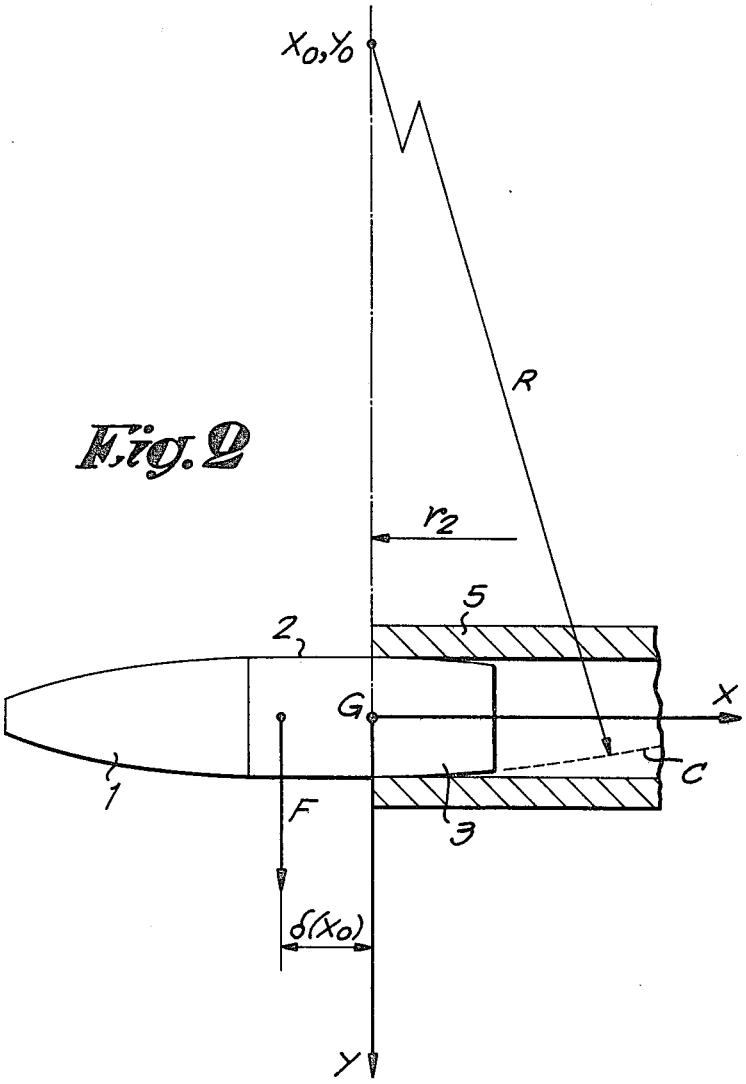
FIG. 2 relates to the shape of the tail of the projectile as well as to the importance of the position of the centre of gravity.

For a good understanding of the tilting-effect and especially of the torque resulting from it, FIG. 2 gives a good description of the phenomon.

If there is an error "$\delta$" in the location of the centre of thrust or centre of gravity, a torque $F_t \cdot \delta$ results thereof.

To clarify the views, an error $\delta=0.1$ mm gives a torque (at the muzzle of the gun) $C=16400\times0.1\times10^{-3}=1.64$ kgm. This last value, high as it may be, will only have little effect on the shell itself.

In order to calculate the values of the rotations, a little calculation is required.

In fact, consideing the shell as an equivalent (steel) cylinder of 80 mm length, with a diameter of 15.77 mm (in order to respect the weight of 122 g) the following moment of inertia is obtained:

$$I = \frac{P}{g}\left(\frac{r^2}{4} + \frac{h^2}{12}\right) = \frac{0{,}122}{9{,}81}\left(\frac{7{,}88\cdot10^{-32}}{4} + \frac{80\cdot10^{-32}}{12}\right) = 6{,}8257\cdot10^{-6}\ \text{kg'msec}^2$$

$$C = I\frac{d^2\theta}{dt^2} = I\cdot\theta''$$

Hence $$\theta'' = \frac{C}{I} = \frac{1,64}{6,8257 \cdot 10^{-6}} = 240266,8 \text{ rad/sec}^2$$

With $V_R$=800 m/s, the departure of the shell takes place in about 4 degrees (in order to release the tail only). This corresponds to a time calculated as follows:

$$N = 12433 \text{ rpm for the wheel}$$

$$t = \frac{60.4}{360.12443} = 5,357 \times 10^{-5}\text{s}$$

Hence $$\omega = \theta'' \times t = 240266.8 \times 53.57 \times 10^{-6} = 12.87 \text{ rad/s}$$

The rotation that would result therefrom would be $$\theta = \frac{\theta'' t^2}{2} = 3.448 \times 10^{-4} \text{ rad or}$$

$$= 0.0197 \text{ degrees.}$$

Summarizing we can say that the effects of an incorrect position of the center of gravity only have any influence for the "δ" exceeding 1 mm (δ=2 mm, C=32.8 kgm, θ=0.395 degrees).

In this meaning has to be understood the expression "in the immediate vicinity of" used hereinabove as well as in the main claim.

The limiting shape of the generatrix of tail 3 which avoids any contact with the gun-vane 5 is defined by a calculated enveloping curve of which the equation in the system of axes of FIG. 2 is:

$$x = A(\alpha + \tfrac{1}{2}\sin 2\alpha) + B + C \sin\alpha - D \cos^2\alpha$$

$$Y = D\,(\tfrac{1}{2}\sin 2\alpha - \alpha) + C \cos\alpha - A \sin^2\alpha.$$

The angle α, expressed in radians, is the angle the turbine (or gun) has to cover in order to completely eject the tail of the shell, the origin being taken at the moment when the center of gravity G of the shell reaches the extremity of the gun (radius $r_2$).

$$\left.\begin{array}{l} A = K \sin\mu \\ D = K \cos\mu \end{array}\right\} \text{ with } K = \frac{30}{\pi} \; \frac{V_R}{N}$$

B=$r_2$ or extreme radius of the gun.

C=½ calibre or radius of the calibre.

N in rpm

V is the tangential speed of the shell.

v is the radial ejection speed of the shell.

$V_R$ is the resulting speed of the projectile at radius $r_2$.

The angle μ is the angle between the direction of the resulting speed $V_R$ and the tangential speed V.

This angle decreases with increasing coefficient of friction.

It is at its maximum for a coefficient=0. In these conditions:

$$\mu = \arctan \frac{v}{V} = \arctan \frac{\omega \sqrt{r_2^2 - r_1^2}}{\omega r_2}$$

In the case of a rectilinear gun-vane the maximum value of μ is given for $r_1$=0; ($r_1$=radius of center of the most central straight section) where $$\mu = \arctan 1 = 45°$$

whence $v = V$.

Concerning the coefficients A and D it should be noted that for a given device ($r_2$ and $r_1$ as well as the coefficient of friction being fixed - even if the latter is unknown) sin μ is determined and constant; now $V_R$ is proportional to N whence $$\frac{V_R}{N} \sin\mu \text{ or } \frac{V_R}{N} \cos\alpha = \text{constants.}$$

The calculation shows that $V_R$ is linked to N by a system of equations.

Consequently, if A and D are constants for a given device, the enveloping is expressed by the parametrical equations x and y, (the calibre of course being fixed as well).

In these conditions the enveloping curve depends on the dimensions $r_1$, $r_2$ of the device, the calibre and the coefficient of friction. So, for a given device, whatever its speed, the enveloping curve is fixed.

What precedes can be extended saying that for a zero coefficient of friction the enveloping curve found moreover is the enveloping curve of all the other where η≠0.

Besides if the radius $r_1$ is supposed to be equal to 0, the maximum enveloping curve is consequently obtained and for a fixed given device with fixed $r_2$ and calibre the enveloping curve is the enveloping of all possible cases. So, the enveloping curve only depends on $r_2$ and on the calibre.

In these conditions:

$$X = r_2\,(\sin^2\alpha + \tfrac{1}{2}\sin 2\alpha + \alpha) + C \sin\alpha.$$
$$Y = r_2(\tfrac{1}{2}\sin 2\alpha - \sin^2\alpha - \alpha) + C \cos\alpha$$

α being expressed in radians.

For example, for a given radius of 475 mm and a calibre of 20 mm meaning C=10 mm, the limiting enveloping curve can be calculated point by point. The curve adopted in practise for reasons of convenience of machining can be located closer to the axis of the projectile, but it cannot go beyond the said limiting curve where f=0 and $r_1$=0.

In practice, the latter condition will require to stay pretty close to this limiting curve, for example by taking the chord or a parallel to it. This is even more true in the case where the head 1 has to be equipped with a rocket and the body 2 to contain an explosive charge.

It has to be noticed that the maximum value of the angle μ(45° for η=0 and $r_1$=0) mentioned hereabove could be exceeded by non-rectilinear gun-vane, capable of increasing the radial ejecting speed v considerably and consequently the resulting speed $V_R$ of the shell.

Because the launching of the projectile at speeds equal to or higher than 800 m/s could give rise to viscous tearing-away during translation in the gun-vane as well as to a superficial plastification at the exit of the latter, it is advised to give body 2 an appropriate surface treatment, for example with copper.

What I claim is:

1. A projectile for a centrifugal gun having a gun vane for launching the projectile, comprising: (a) an ogival head portion; (b) a generally cylindrical body portion joined to the ogival head portion in a first transverse plane, the diameter of the cylindrical body portion being equal to the longest diameter of the ogival head portion; and (c) a tail portion joined to the cylindrical body portion in a second transverse plane, the center of gravity of the projectile being within 1.5 mm of the second transverse plane, the outer surface of the tail portion being curved, the curve being defined by a system of Cartesian axes located in an axial plane of the projectile wherein the x-axis coincides with the longitudinal axis of the projectile and the y-axis extends from the junction of the cylindrical body portion and the tail portion such that:

$$x=A(\alpha+\tfrac{1}{2}\sin 2\alpha)+B+C\sin\alpha-D\cos^2\alpha$$

$$y=D(\tfrac{1}{2}\sin 2\alpha-\alpha)+C\cos\alpha-A\sin^2\alpha$$

where:

$\alpha$=angle (in radians) the gun turbine must cover to completely eject projectile $$\left.\begin{aligned} A &= K\sin\mu \\ D &= K\cos\mu \end{aligned}\right\} K=\frac{30}{\pi}\,\frac{V_R}{N}$$

$\mu$=arctan $v^{v}$ v=radial ejection speed m/s

V=tangential speed $V_R$=resulting speed

N in rpm

B=extreme radius of gun=$r_2$

C=½ calibre or radius of the calibre.

2. Projectile according to claim 1, characterized in that the said body is provided with a protective surface treatment, for example of copper.

* * * * *